US008932417B1

(12) United States Patent
Renz et al.

(10) Patent No.: US 8,932,417 B1
(45) Date of Patent: Jan. 13, 2015

(54) METHODS AND SYSTEMS FOR MANUFACTURING PROPELLANTS

(75) Inventors: Robert Nicholas Renz, Phoenix, AZ (US); James Lemister, Phoenix, AZ (US); Steven Ray Johnson, Hollister, CA (US); Ralph Chengkung Hsiao, Davis, CA (US)

(73) Assignee: Pacific Scientific Energetic Materials Company, Valencia, CA (US)

( * ) Notice: Subject to any disclaimer, the term of this patent is extended or adjusted under 35 U.S.C. 154(b) by 985 days.

(21) Appl. No.: 11/808,560

(22) Filed: Jun. 11, 2007

(51) Int. Cl.
*D03D 23/00* (2006.01)
*D03D 43/00* (2006.01)

(52) U.S. Cl.
USPC ..... 149/109.6; 149/109.2; 149/109.4

(58) Field of Classification Search
USPC ..... 149/109.6, 109.2, 109.4
See application file for complete search history.

(56) References Cited

U.S. PATENT DOCUMENTS 3,214,308 A * 10/1965 Rice ..... 149/76
4,697,929 A * 10/1987 Muller ..... 366/97
5,383,163 A * 1/1995 Brunn ..... 366/217
6,503,350 B2 * 1/2003 Martin et al. ..... 149/37
2002/0053377 A1 * 5/2002 Martin et al. ..... 149/17
2003/0103409 A1 * 6/2003 Mukasa et al. ..... 366/139
2004/0129356 A1 * 7/2004 Doll et al. ..... 149/92

OTHER PUBLICATIONS

Kurabo Industries Ltd., "Planetary Mixer/Deaerator Mazerustar," 3 pages, 2005.
Thinky Corporation, "Centrifugal Hybrid Mixer Deaerator, AR-Series ARV-Series," 2 pages, 2004.

* cited by examiner

*Primary Examiner* — James McDonough
(74) *Attorney, Agent, or Firm* — Perkins Coie LLP

(57) ABSTRACT

Methods and systems for mixing propellant formulations are disclosed herein. In one embodiment, a method of mixing a solid propellant formulation includes placing a first component (e.g., a polymer or fuel) and a second component (e.g., an oxidizer of suitable particle size) in a mix vessel. The method further includes mixing the first and second components together by rotating the mix vessel about a first axis and, during at least a portion of the vessel rotation, revolving the vessel about a second axis spaced apart from the first axis. In one embodiment, the first axis can be a vessel spin axis, and the second axis can be spaced apart from the first axis so that the vessel revolves about the second axis in a planetary manner. In another embodiment, the vessel can rotate about the first axis in a first direction while revolving about the second axis in a second direction, opposite to the first direction.

25 Claims, 4 Drawing Sheets

METHODS AND SYSTEMS FOR MANUFACTURING PROPELLANTS

TECHNICAL FIELD

The following disclosure relates generally to the manufacture of propellants and, more particularly, to methods and systems for mixing solid propellant formulations.

BACKGROUND

Solid propellant is used in various types of rocket and missile motors, and is typically composed of a polymer, such as polybutadine, cellulose acetate, or polyvinylchloride, and a finely ground oxidizer, such as a perchlorate or nitrate salt. Various types of modifiers, such as plasticizers, burn-rate catalysts, or stabilizing agents, can be added to the propellant mixture to modify the structural or performance characteristics. In the manufacture of solid propellants, the polymer, which acts as the fuel, is typically mixed with the oxidizer(s) and modifier(s) in an uncured, fluid state. A curing or cross-linking agent is then added to the mixture before it is cast in the desired shape and cured.

Conventional planetary mixers and paint shaker-type equipment are often used to mix solid propellants. Planetary and double planetary mixers, such as those provided by Baker Perkins Inc., of 3223 Kraft Ave. S.E., Grand Rapids, Mich. 49512, and Charles Ross & Son Company, of 710 Old Willets Path, Hauppauge, N.Y. 11788, typically include two curved blades that extend into the propellant mix vessel and rotate about their own axes, while orbiting the mix vessel on a common axis. The blades continually advance around the periphery of the mix vessel during the mixing process, while the mix vessel remains stationary. Paint shaker-type mixers, such as those provided by Red Devil Equipment Co., of 14900 21st Ave. N., Plymouth, Minn. 55447, shake the mix vessel back and forth at a high frequency to fully mix the propellant ingredients together.

The ratio of polymer to oxidizer in solid propellant formulations is generally such that the resultant combustion products are low molecular weight gaseous products, such as carbon monoxide, nitrogen, hydrogen, water, and hydrogen chloride. To modify the linear burn rate of propellant, the oxidizer is typically ground to a specific particle size, such as about 100 to 300 microns. Finer particle distributions generally produce higher burn rates and, consequently, greater thrust. Using an oxidizer that is ground too fine, however, can result in propellant formulations that are very viscous and difficult to mix using the current state-of-the-art processes. As a result, conventional propellant formulations are generally constrained to linear burn rates ranging from about 0.1 inch per second to about 1.5 inches per second at chamber pressures of about 1,000 psi. Another shortcoming of conventional mixing processes is the amount of time it typically takes to achieve a relatively homogenous propellant mixture. Conventional planetary mixers, for example, typically require about 6 to 8 hours to provide a relatively homogenous mixture, while conventional paint shaker-type equipment can require from 1 to 2 hours.

Accordingly, it would be advantageous to have a method of producing relatively homogenous propellant mixtures in a relatively short period of time. In addition, it would also be advantageous to have a method of producing relatively homogenous propellant mixtures having oxidizer particles that are small or fine enough to provide linear burn rates higher than 1.5 inches per second.

DETAILED DESCRIPTION

Figure 1:
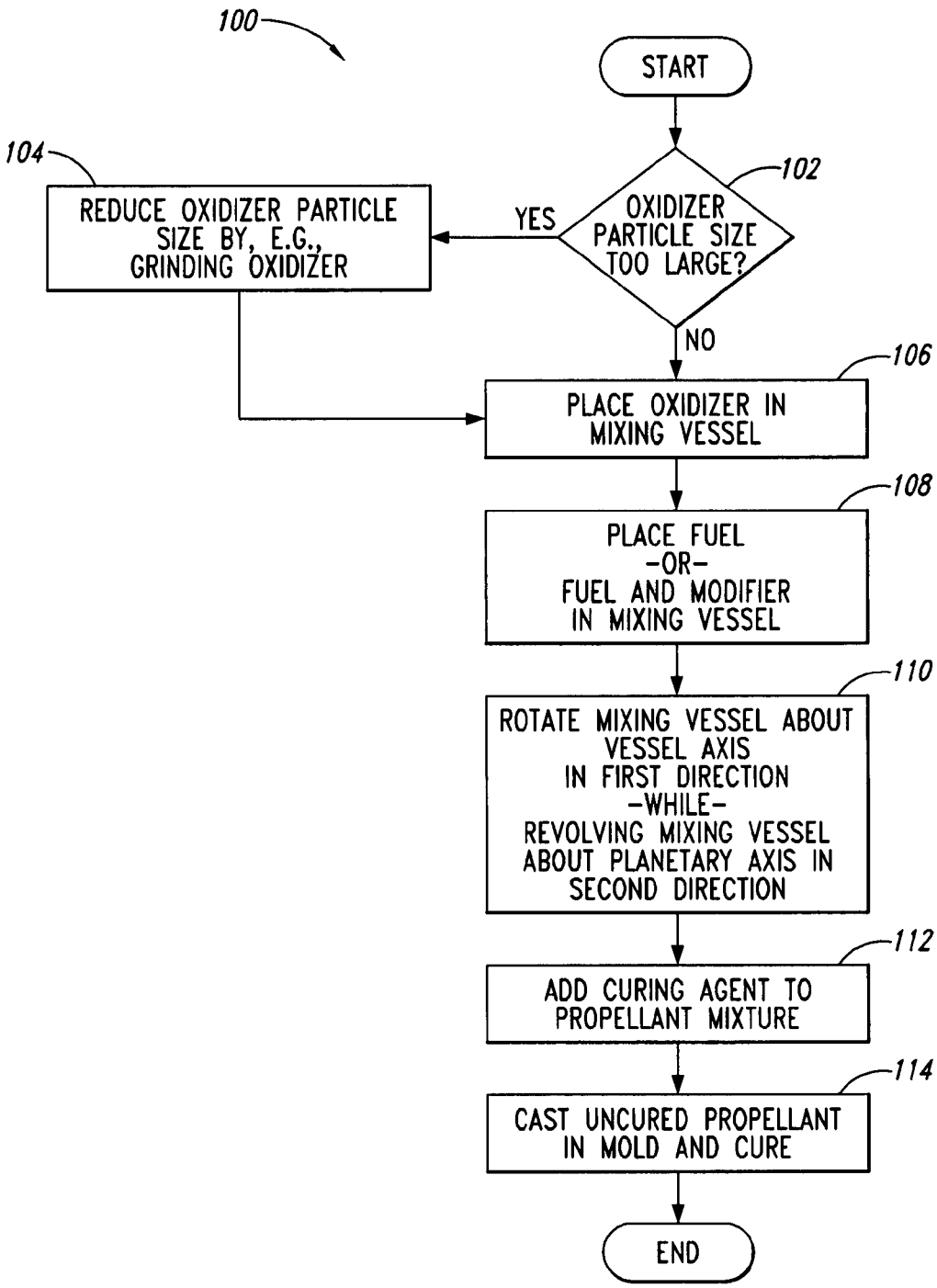
FIG. 1 is a flow diagram illustrating a method of manufacturing propellant in accordance with an embodiment of the invention.

The following disclosure describes various embodiments of methods and systems for mixing and manufacturing solid composite propellant formulations. In one embodiment, for example, a method of manufacturing propellant includes placing a first component (e.g., a polymer) and a second component (e.g., an oxidizer) in a mix vessel. In this embodiment, the oxidizer can have an average particle size that is substantially less than that typically found in conventional solid propellant formulations to achieve a higher burn rate. The method can further include mixing the first component with the second component by rotating the mix vessel about a first axis (e.g., a spin axis passing through the center of the mix vessel) while revolving the mix vessel about a second axis (e.g., a planetary axis) that is offset from the first axis. As described in greater detail below, mixing the first and second components together in this manner can cause high shear forces in the mixture that result in a relatively homogenous product that is substantially free of air bubbles.

Certain details are set forth in the following description and in FIGS. 1-4 to provide a thorough understanding of various embodiments of the invention. Other details describing well-known methods and systems often associated with propellant formulations, propellant mixing procedures, and propellant mixing systems, however, are not set forth in the following disclosure to avoid unnecessarily obscuring the description of the various embodiments of the invention.

Many of the details, dimensions, and other features shown in the Figures are merely illustrative of particular embodiments of the invention. Accordingly, other embodiments can have other details, dimensions, and features without departing from the spirit or scope of the present invention. In addition, further embodiments of the invention can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 210 is first introduced and discussed with reference to FIG. 2.

Various aspects and embodiments of the invention described below can be implemented in accordance with computer-readable instructions, such as routines executed by a computer or data processor configured or constructed to perform one or more of the method steps described below. Various aspects of the invention can be stored or distributed on computer-readable media, including magnetic and optically readable computer disks, stored as firmware in chips (e.g., EEPROM chips), as well as distributed electronically over a computer network (including wireless networks). Those skilled in the relevant art will recognize that portions of the invention may reside on a special purpose computer, such as a propellant mixer computer, while corresponding portions may reside on a remote server computer. The computers and other processing devices used to implement various embodiments of the invention described below can include one or more central processing units or other logic-processing circuitry, memory, input devices (e.g., touch-pads, keyboards, etc.), output devices (e.g., display devices and printers), and storage devices (e.g., magnetic, fixed, and floppy disk drives, and optical disk drives), known to those of ordinary skill in the art. Such computers may be general-purpose devices that can be programmed to run various types of applications, or single-purpose devices optimized or limited to a particular function (e.g., a propellant mixing function) or class of functions.

FIG. 1 is a flow diagram of a method 100 for manufacturing propellant in accordance with an embodiment of the invention. In this method, the propellant includes a first portion of oxidizer that is mixed with a second portion of a polymer or fuel. In decision block 102, the method determines if the oxidizer particle size is too large to achieve the desired linear burn rate. If not, the method proceeds directly to block 106. If the oxidizer particle size is too large, then the method proceeds to block 104 and reduces the oxidizer particle size by, e.g., grinding the oxidizer with a hammer mill, fluid energy mill, etc., or by another suitable method known in the art. In one embodiment, conventional oxidizer particles may be commercially available in sizes ranging from about 200 to about 300 microns. Oxidizer particles in this size range tend to produce linear burn rates of about 0.1 inch per second to about 1.5 inches per second at chamber pressures of about 10,000 psi. Increasing the linear burn rate of the propellant to rates higher than 1.5 inches per second (e.g., higher than about 3.0 inches per second, such as from about 8.0 to about 9.0 inches per second) can be achieved by reducing at least a portion of the oxidizer particles to sizes ranging from about 0.3 microns to about 50 microns, such as from about 0.5 microns to about 15 microns.

Propellant formulations can also include a blend of oxidizer sizes. For example, in one embodiment, a propellant formulation manufactured in accordance with the method 100 can include a first portion of oxidizer having a first range of particle size (e.g., an "ultra fine" size), a second portion of oxidizer having a second range of particle size (e.g., a "medium" size), and a third portion of oxidizer having a third range of particle size (e.g., a "coarse" size). In one embodiment, the ultra fine particle size can range from about 0.3 microns to about 5 microns, the medium particle size can range from about 5 microns to about 30 microns, and the coarse particle size can range from about 150 microns to about 300 microns. In another embodiment, the total amount of oxidizer in a propellant mixture can account for about 85% of the mixture by weight, with the first portion of ultra fine oxidizer accounting for about 50-55% of the total, the second portion of medium oxidizer accounting for about 20-35% of the total, and the third portion of coarse oxidizer accounting for about 2-10% of the total. In other embodiments, other propellant formulations manufactured in accordance with the method 100 can include other proportions of oxidizer having other particle sizes. After reducing the size of at least a portion of the oxidizer particles, the method proceeds to block 106.

In block 106, the method places the desired portion of oxidizer in a mixing vessel. In block 108, the method places a second portion of a fuel (e.g., a polymer), or a second portion of fuel and a third portion of a modifier (e.g., a plasticizer, burn rate catalyst, stabilizer, etc.) in the mixing vessel with the oxidizer. In block 110, the method rotates the mixing vessel in a first direction about a first axis, while (at least partially simultaneously) revolving the mixing vessel in a second direction about a second axis. In this embodiment, the first axis can be a central axis, such as a spin axis, which is aligned with a centerline of the vessel, and the second axis can be a planetary axis that is offset from, and spaced apart from, the central axis. Various embodiments of the first and second axes and the associated vessel motions are described in greater detail below with reference to FIGS. 2 and 3.

In block 112, a curing agent can be added to the propellant mixture prior to casting. In block 114, the propellant mixture can be poured or otherwise cast in rocket motor casing, missile casing, or other suitable mold, and cured to harden the propellant in a desired shape. After block 114, the method ends.

Figure 2:
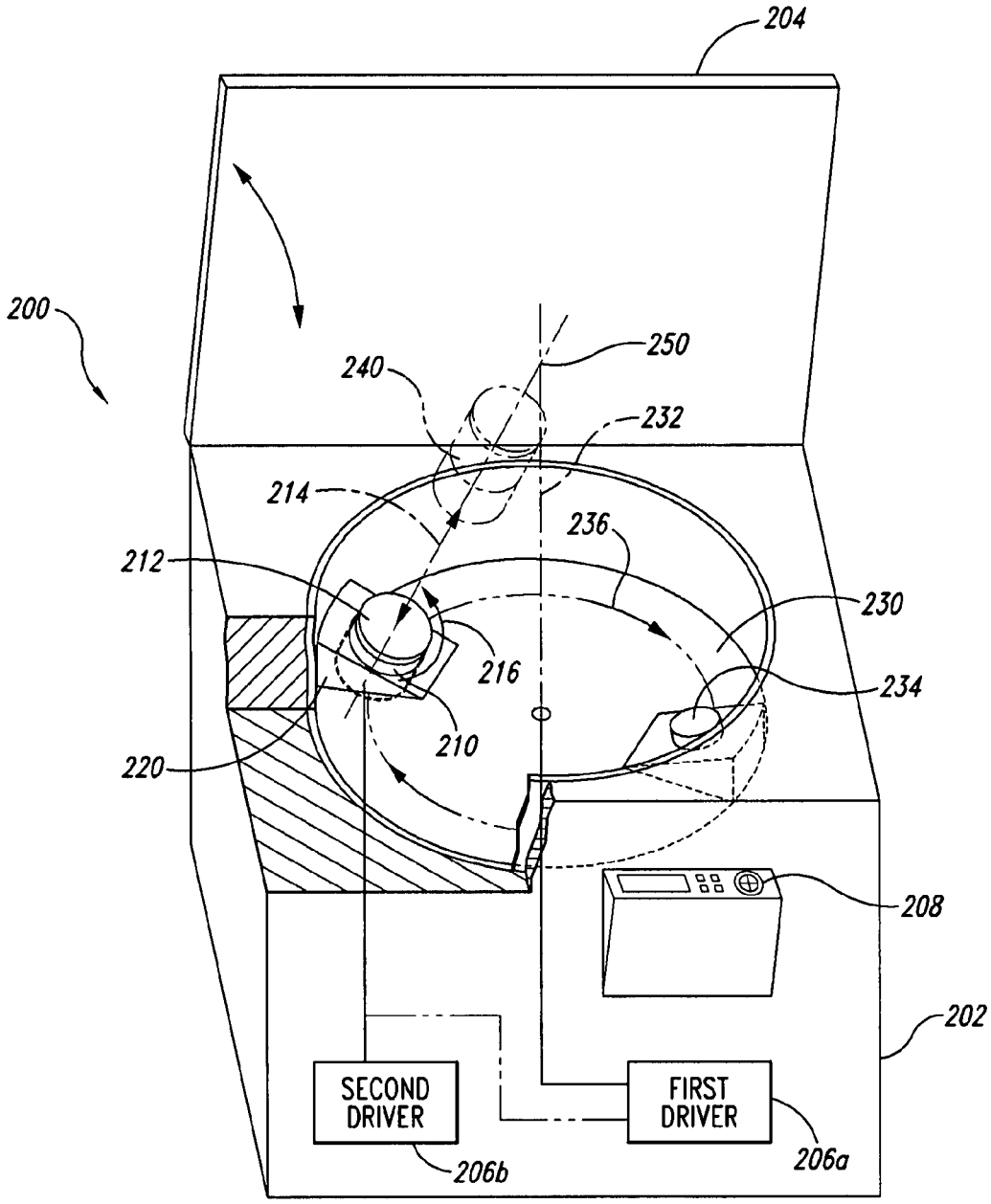
FIG. 2 is an isometric view of a propellant mixing system configured to perform at least a portion of the method of FIG. 1.

FIG. 2 is a partially schematic, cut-away isometric view of a mixing system 200 for mixing composite propellant formulations in accordance with embodiments of the invention. In one aspect of this embodiment, the mixing system 200 includes a mixer body or housing 202 having a closable top cover 204 hingeably attached thereto. A turntable or rotor 230 is rotatably positioned in the housing 202. A first driver 206*a*, such as a first electric motor (shown schematically), can be configured to rotate or spin the rotor 230 in a first direction 236 about a first or planetary axis 232.

In another aspect of this embodiment, a propellant mix vessel 210 is removably carried in a receptacle 220 on the rotor 230. The mix vessel 210 can include a body 213 and a removable lid 212. The capacity of the mix vessel 210 can range from about one quart to about 50 gallons, depending on the desired quantity of propellant, the capability of the mixing system 200, and other factors. A second driver 206*b* (or, optionally, the first driver 206*a*), can be operably coupled to the receptacle 220 and configured to rotate or spin the mix vessel 210 in a second direction 216 about a second or central axis 214 while the rotor 230 is revolving in the first direction 236 about the planetary axis 232. In addition to the foregoing components, the mixing system 200 can also include an adjustable counterweight system 234 positioned approximately opposite to the mix vessel 210. Prior to operation, the counterweight system 234 can be adjusted to reflect the corresponding weight of the mix vessel 210 and reduce vibration of the mix system 200 during operation.

In the illustrated embodiment, the rotation of the rotor 230 about the planetary axis 232, and/or the rotation of the mix vessel 210 about the central axis 232, can be controlled in accordance with time, speed, and/or other operational parameters received from a user (not shown) via a control panel 208. In other embodiments, all or a portion of the various mixing parameters can be preprogrammed on suitable computer-readable media and executed automatically, or at least partially automatically, by a computer or other processing device which is operably connected to the mixing system 200.

To mix propellant in accordance with the present invention, the user places a desired formulation (composed of, for example, a first portion of fuel and a second portion of oxidizer of suitable particle size to provide the desired burn rate) in the mix vessel 210 and secures the lid 212. The mix vessel 210 is then placed in the receptacle 220 and the top cover 204 is closed. The user can then start the mixing system 200 by pressing the appropriate button or buttons on the control panel 208.

In operation, the rotor 230 revolves about the first axis 236 in the first direction 236 (e.g., the clockwise direction). For at least a portion of the time the rotor 230 is revolving, the mix vessel 210 rotates about the central axis 214 in the second direction 216 (e.g., the counter-clockwise direction). In the illustrated embodiment, the second direction of rotation 216 is opposite to the first direction of rotation 236. In other embodiments, however, the first and second directions of rotation can be the same (e.g., both clockwise or both counter-clockwise). Furthermore, in the illustrated embodiment, the spin or central axis 214 of the mix vessel 210 intersects the planetary axis 232 at a point in space 250 that is spaced apart from the mix vessel 210. In other embodiments, however, the central axis 214 can be at least generally parallel to the planetary axis 232, as described in greater detail below with reference to FIG. 3.

The relative rotational speeds of the mix vessel 210 and/or the rotor 230 can be varied to achieve desired mixing results depending on the particular composition of the propellant formulation and/or other factors. For example, when the oxidizer comprises about 70 to 90% of the mixture (e.g., about 85% of the mixture), the rotor 230 can revolve at about 500 to 1000 revolutions per minute (RPM) about the planetary axis 232, and the mix vessel 210 can spin at about 600 to 800 RPM in the opposite direction about the central axis 214. In other embodiments, other rotational speeds of the rotor 230 and/or the mix vessel 210 can be used to accommodate other propellant formulations, reduce mix time, or for other reasons. In addition, the rotational speeds can also be varied according to a preset program. For example, the rotational speed of one or both of the rotor 230 and/or the mix vessel 210 can be increased or decreased in a stepwise fashion; and rotation of one or both of the rotor 230 and/or the mix vessel 210 can be stopped or slowed down while rotation of the other of the rotor 230 or the mix vessel 210 is sped up.

There are commercially available paint mixing systems that are at least generally similar in structure and function to the propellant mixing system 200 described above with reference to FIG. 2. Such systems are provided by, for example, the Thinky Corporation of Tokyo, Japan (see, e.g., the Thinky ARE mixers at http://wwvv.thinky.co.jp/english/index.html), and by Kurabo Industries, Ltd. of Osaka, Japan (see, e.g., the Mazerustar mixers at http://www.kurabo.co.jp/el/kk/kk_e01.html). This particular type of mixing system is disclosed herein for purposes of illustrating one possible type of system for carrying out the mixing methods of the present invention. As will be appreciated by those of ordinary skill in the art, however, other types of commercially available mixing systems, or portions thereof, as well as other specially-designed mixing systems, can be used to mix propellants in accordance with the methods disclosed herein. Accordingly, the invention is not limited to the particular types of mixing systems described herein, but extends to other types of mechanical systems capable of performing the propellant mixing methods of the present invention.

Figure 3:
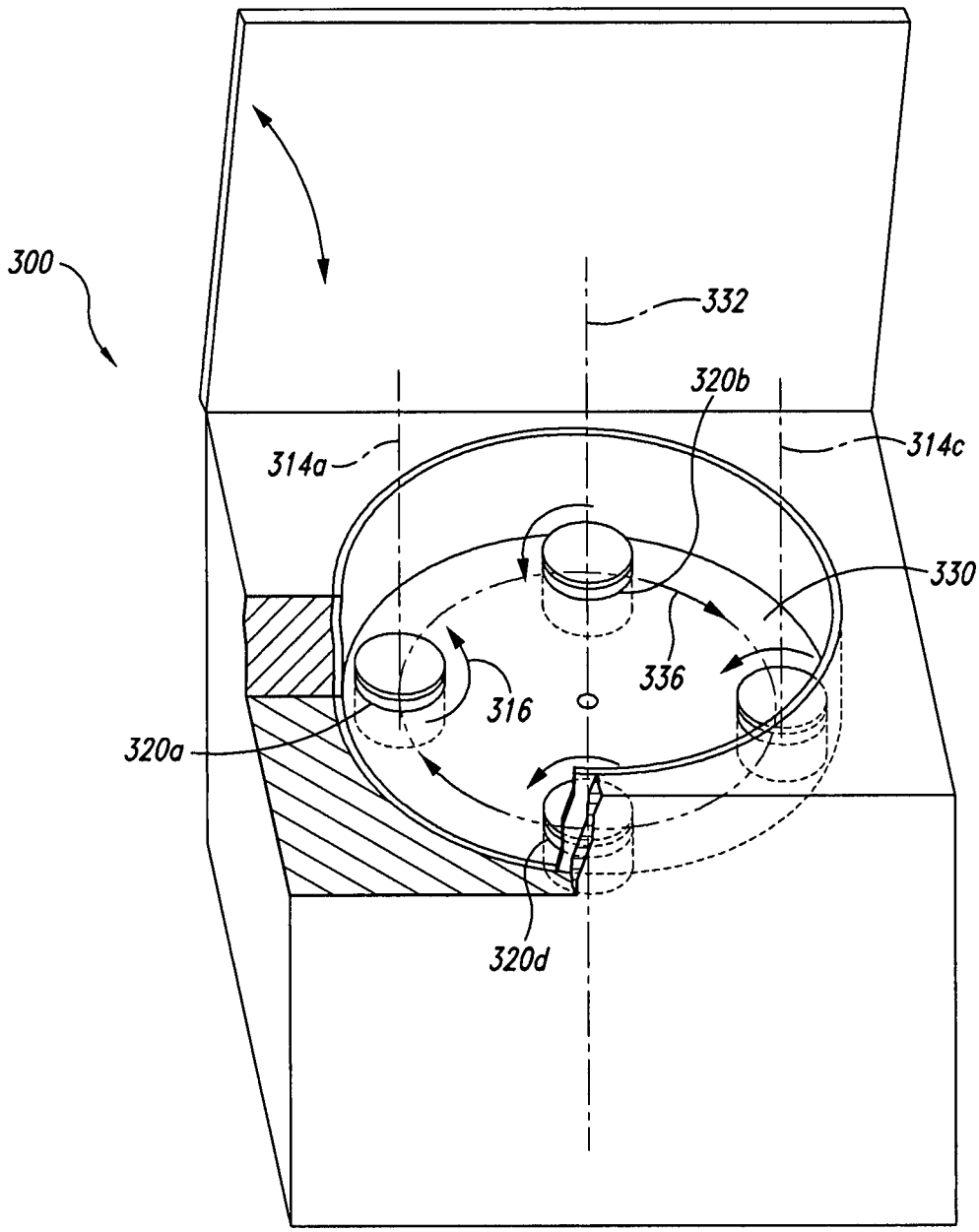
FIG. 3 is an isometric view of another propellant mixing system configured to perform at least a portion of the method of FIG. 1.

FIG. 3 is a partially cut-away isometric view of a mixing system 300 for mixing composite propellant formulations in accordance with another embodiment of the invention. Many features of the mix system 300 are at least generally similar in structure and function to corresponding features of the mixing system 200 described above with reference to FIG. 2. In this particular embodiment, however, the mixing system 300 includes a plurality of propellant mix vessels 320 (identified individually as mix vessels 320*a-d*) evenly spaced around a turntable 330. In operation, the turntable 330 revolves about a planetary axis 332 in a first direction 336 (i.e., a clockwise direction), while each of the mix vessels 320 spins about a corresponding central axis 314 in a second direction 316 (i.e., a counter-clockwise direction). In the illustrated embodiment, the spin axis 314 of each of the mix vessels 320 is at least approximately parallel to the planetary axis 332.

The arrangement of multiple mix vessels illustrated in FIG. 3 may provide certain advantages over the single mix vessel configuration of FIG. 2 in that a larger amount of propellant can be mixed during a single operation. As the foregoing illustrates, various types of mixing equipment can be used to mix propellant formulations in accordance with the present invention, and the methods and systems described herein are not limited to the particular systems described above with reference to FIGS. 2 and 3.

Figure 4:
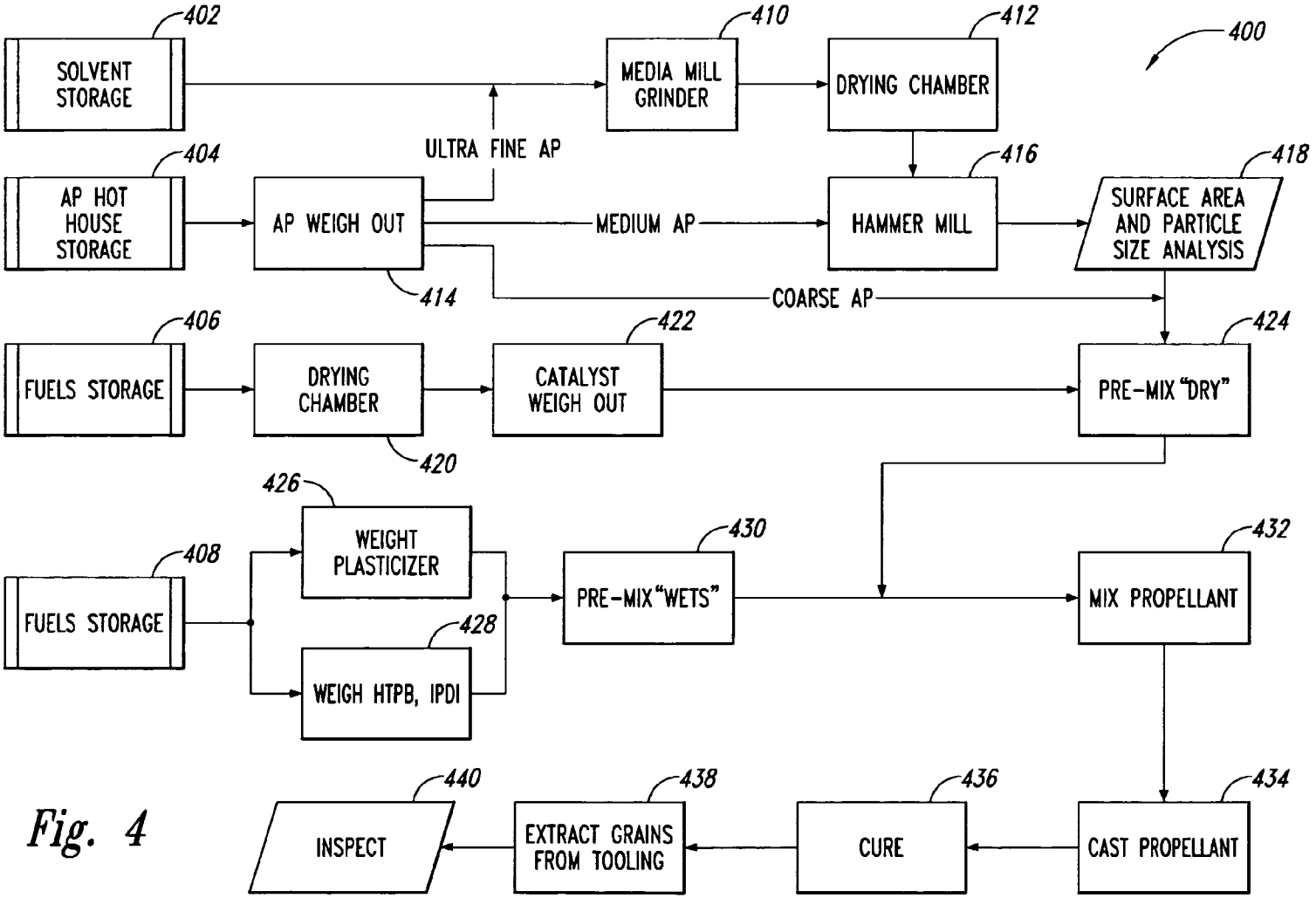
FIG. 4 is a flow diagram illustrating a method of manufacturing propellant in accordance with another embodiment of the invention.

FIG. 4 is a flow diagram illustrating various stages in a method 400 of manufacturing propellant in accordance with another embodiment of the invention. In this embodiment, ammonium perchlorate ("AP"), or another suitable oxidizer, is removed from hot house storage 404 and weighed out in block 414. A first portion of the oxidizer is combined with solvent from solvent storage 402 in a media mill grinder 410. The first portion of oxidizer is ground into ultra fine oxidizer particles in the medium mill grinder 410, and then transferred to a drying chamber 412 before passing to a hammer mill 416. The second portion of oxidizer is reduced to a medium particle size in the hammer mill 416, where it is combined with the ultra fine oxidizer from the drying chamber 412. After passing from the hammer mill 416, the mixture of medium and ultra fine oxidizer particles are analyzed for surface area and particle size in block 418. The oxidizer mixture from the hammer mill 416 is then dry-mixed with a third portion of coarse oxidizer in block 424. A portion of catalyst from fuel storage 406 is dried in chamber 420 and weighed out in block 422, before being combined with the oxidizer mixture in block 424.

Modifiers, such as plasticizers and butadiene (e.g., hydroxy-terminated polybutadiene (HTPB)), from fuel storage 408 are weighed out in blocks 426 and 428, respectively, before being mixed together in block 430. The wet mixture is then combined with the dry oxidizer mixture in block 432. Various embodiments of the systems and methods described above with reference to FIGS. 1-3 can be used to mix the propellant formulation in block 432. After mixing, the propellant is cast in block 434 and cured in block 436. After curing, the propellant grain is extracted from the tooling in block 438 and inspected in block 440.

There are a number of advantages associated with the propellant mixing methods described above with reference to FIGS. 1-4. One advantage is that simultaneous counter-rotation about two axes can generate relatively high shear forces in the propellant mixture that result in a relatively smooth, homogenous and de-aerated propellant mixture. Furthermore, the methods described herein can also be used to mix propellant formulations with viscosities that are significantly higher (e.g., about 500 to 1000% higher) than formulations which can be sufficiently mixed using current state of the art mixing processes. This enables the use of finely ground oxidizer particles that can provide higher linear burn rates than can be achieved with conventional composite propellants. For example, these methods can accommodate oxidizer particles ranging in size from about 10 microns to about 30 microns. Oxidizer particles of this size can provide linear burn rates from about 3.0 to about 8.5 inches per second at chamber pressures of about 10,000 psi.

The methods disclosed herein can also reduce propellant manufacturing cycle times by approximately 50-90% due to higher efficiency mixing. For example, conventional blade-type planetary mixing systems can require about 6-8 hours to achieve a homogenous mixture, and conventional paint shaker-type mixers can require about 1-2 hours to achieve this result. In contrast, the mixing methods described herein can produce homogenous propellant mixtures in cycle times as low as 10 minutes or less, such as about 6-8 minutes. The mixing methods described herein can also reduce or eliminate trapped gases or air in propellant mixtures which can lead to poor performance during propellant burn.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A method of manufacturing a propellant with reduced mixing time, the method comprising:

placing a first component of the propellant in a mix vessel, wherein the first component is a fuel;

placing a second component of the propellant in the mix vessel, wherein the second component is an oxidizer, wherein the oxidizer includes particles in:

an ultra fine range of sizes from about 0.3 microns to about 5 microns, and a medium range of sizes from about 5 microns to about 30 microns;

placing the mix vessel in a turntable capable of rotating about a generally vertical axis; and mixing the first and second components with minimal aeration until the propellant is a relatively smooth, homogenous and de-aerated mixture by:

rotating the vessel about a first axis; and while rotating the vessel about the first axis, revolving the vessel about a second axis of the turntable spaced apart from the first axis, wherein the first and the second axis do not intersect;

wherein rotating the vessel about the first axis and revolving the vessel about the second axis of the turntable imparts to the propellant a shear force to minimize aeration of the propellant.

2. The method of claim 1 wherein rotating the vessel about a first axis includes rotating the vessel in a first direction, and wherein revolving the vessel about a second axis includes revolving the vessel in a second direction opposite to the first direction.

3. The method of claim 1 wherein rotating the vessel about a first axis includes rotating the vessel in a first direction about a central axis passing through the vessel, and wherein revolving the vessel about a second axis includes revolving the vessel in a second direction about a planetary axis spaced apart from the vessel.

4. A method of manufacturing a propellant with reduced mixing time, the method comprising:

placing a first component of the propellant in a mix vessel, wherein the first component is a fuel;

placing a second component of the propellant in the mix vessel, wherein the second component is an oxidizer, wherein the oxidizer includes particles in:

a medium range of sizes from about 5 microns to about 30 microns, and a course range of sizes from about 150 microns to about 300 microns, placing the mix vessel in a turntable capable of rotating about a generally vertical axis; and mixing the first component with the second component until the propellant is a relatively smooth, homogenous and de-aerated mixture by:

rotating the vessel about a first axis;

while rotating the vessel about the first axis, revolving the vessel about a second axis of the turntable spaced apart from the first axis, wherein the first and the second axis do not intersect;

removing a mixture of the first and second components from the vessel; and hardening the mixture in a mold to form a solid propellant motor;

wherein rotating the vessel about the first axis and revolving the vessel about the second axis of the turntable imparts to the propellant a shear force to minimize aeration of the propellant.

5. A method of manufacturing solid a propellant with reduced mixing time, the method comprising:

placing a first portion of the propellant in a vessel, wherein the first portion is a fuel;

placing a second portion of the propellant in the vessel, wherein the second portion is an oxidizer, wherein the oxidizer includes particles in:

an ultra fine range of sizes from about 0.3 microns to about 5 microns, and a medium range of sizes from about 5 microns to about 30 microns;

placing the vessel in a turntable capable of rotating about a generally vertical axis;

rotating the vessel in a first direction about a first axis, wherein the first axis passes through the vessel; and while rotating the vessel about the first axis, revolving the vessel in a second direction about a second axis of the turntable until the propellant is a relatively smooth, homogenous and de-aerated mixture, wherein the second axis is spaced apart from and intersects the first axis at a point in space away from the vessel;

wherein rotating the vessel about the first axis and revolving the vessel about the second axis of the turntable imparts to the propellant a shear force to minimize aeration of the propellant.

6. The method of claim 5 wherein revolving the vessel in a second direction includes revolving the vessel in a second direction opposite to the first direction.

7. The method of claim 5 wherein placing a first portion of the propellant and a second portion of the propellant in the vessel includes placing a ratio of about 75% oxidizer and about 25% fuel by weight in the vessel.

8. A method with reduced mixing time of mixing oxidizer particles with a fuel substance to form solid propellant having a relatively high burn rate, the method comprising:

placing a first portion of the oxidizer particles in a vessel, wherein the first portion of oxidizer includes particles in:

an ultra fine range of sizes from about 0.3 microns to about 5 microns, and a course range of sizes from about 150 microns to about 300 microns, placing a second portion of the fuel substance in the vessel;

placing the mix vessel in a turntable capable of rotating about a generally vertical axis;

rotating the vessel in a first direction about a spin axis passing through the vessel; and while rotating the vessel in the first direction about the spin axis, revolving the vessel in a second direction about a planetary axis of the turntable until the propellant is a relatively smooth, homogenous and de-aerated mixture, wherein the planetary axis is spaced apart from and intersects the spin axis at a point in space away from the vessel;

wherein rotating the vessel about the spin axis and revolving the vessel about the planetary axis of the turntable imparts to the propellant a shear force to minimize aeration of the propellant.

9. The method of claim 8, further comprising reducing the size of the first portion of oxidizer particles prior to placing the first portion of oxidizer particles in the vessel.

10. The method of claim 8, further comprising grinding the first portion of the oxidizer particles to reduce the size of the oxidizer particles prior to placing the first portion of the oxidizer particles in the vessel.

11. The method of claim 8 wherein rotating the vessel in a first direction about a spin axis includes rotating the vessel about a centerline axis that intersects the planetary axis.

12. The method of claim 8 wherein rotating the vessel in a first direction about a spin axis includes rotating the vessel about a centerline axis that is angled relative to the planetary axis.

13. The method of claim 8 wherein rotating the vessel in a first direction about a spin axis includes rotating the vessel at a first rotational speed, and wherein revolving the vessel in a second direction about a planetary axis includes revolving the vessel in a second direction at a second rotational speed that is different than the first rotational speed.

14. The method of claim 1 wherein the oxidizer includes particles in a course range of sizes from about 150 microns to about 300 microns.

15. The method of claim 14 wherein the oxidizer in the propellant accounts for about 85% of the mixture by weight, and wherein:

the ultra fine range of sizes accounts for about 50-55% of the total oxidizer, the medium range of sizes accounts for about 20-35% of the total oxidizer, and the course range of sizes accounts for about 2-10% of the total oxidizer.

16. The method of claim 15 wherein the vessel rotates about the first axis at around 500 to 1000 RPM and about the second axis at around 600 to 800 RPM.

17. The method of claim 4 wherein a mixing time is about 6 to 8 minutes to achieve the homogeneous mixture.

18. The method of claim 4 wherein the oxidizer includes particles in an ultra fine range of sizes from about 0.3 microns to about 5 microns.

19. The method of claim 18 wherein the oxidizer in the propellant accounts for about 85% of the mixture by weight, and wherein:

the ultra fine range of sizes accounts for about 50-55% of the total oxidizer, the medium range of sizes accounts for about 20-35% of the total oxidizer, and the course range of sizes accounts for about 2-10% of the total oxidizer.

20. The method of claim 5 wherein the oxidizer includes particles in a course range of sizes from about 150 microns to about 300 microns.

21. The method of claim 20 wherein the oxidizer in the propellant accounts for about 85% of the mixture by weight, and wherein:

the ultra fine range of sizes accounts for about 50-55% of the total oxidizer, the medium range of sizes accounts for about 20-35% of the total oxidizer, and the course range of sizes accounts for about 2-10% of the total oxidizer.

22. The method of claim 8 wherein the oxidizer includes particles in a medium range of sizes from about 5 microns to about 30 microns.

23. The method of claim 22 wherein the oxidizer in the propellant accounts for about 85% of the mixture by weight, and wherein:

the ultra fine range of sizes accounts for about 50-55% of the total oxidizer, the medium range of sizes accounts for about 20-35% of the total oxidizer, and the course range of sizes accounts for about 2-10% of the total oxidizer.

24. The method of claim 8 wherein the vessel rotates about the first axis at around 500 to 1000 RPM and about the second axis at around 600 to 800 RPM.

25. The method of claim 8 wherein a mixing time is about 6 to 8 minutes to achieve the homogeneous mixture.

* * * * *